US009587865B2

(12) United States Patent
Jeong et al.

(10) Patent No.: US 9,587,865 B2
(45) Date of Patent: Mar. 7, 2017

(54) AIR CONDITIONER AND METHOD FOR CONTROLLING THE SAME

(75) Inventors: Hojong Jeong, Seoul (KR); Jaehwa Jung, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 445 days.

(21) Appl. No.: 13/607,032

(22) Filed: Sep. 7, 2012

(65) Prior Publication Data

US 2013/0061614 A1 Mar. 14, 2013

(30) Foreign Application Priority Data

Sep. 9, 2011 (KR) ..... 10-2011-0092061

(51) Int. Cl.

| | |
|---|---|
| ***F25B 45/00*** | (2006.01) |
| ***F25B 49/02*** | (2006.01) |
| *F25B 13/00* | (2006.01) |
| *F25B 40/02* | (2006.01) |
| *F25B 43/02* | (2006.01) |

(52) U.S. Cl.

CPC ..... *F25B 49/02* (2013.01); *F25B 13/00* (2013.01); *F25B 40/02* (2013.01); *F25B 43/02* (2013.01); *F25B 2400/075* (2013.01); *F25B 2400/13* (2013.01); *F25B 2400/16* (2013.01); *F25B 2600/05* (2013.01); *F25B 2600/2523* (2013.01)

(58) Field of Classification Search

CPC ..... F25B 49/02; F25B 13/00; F25B 2400/13; F25B 2400/075

USPC ..... 62/149, 137, 210, 174, 171, 222

See application file for complete search history.

(56) References Cited

U.S. PATENT DOCUMENTS

| | | | | |
|---|---|---|---|---|
| 4,765,149 | A * | 8/1988 | Shiga et al. | 62/174 |
| 5,136,855 | A * | 8/1992 | Lenarduzzi | 62/129 |
| 2011/0100040 | A1* | 5/2011 | Bush et al. | 62/149 |

FOREIGN PATENT DOCUMENTS

| | | | |
|---|---|---|---|
| JP | H07174352 | A * | 7/1995 |
| JP | H09229497 | A * | 9/1997 |

(Continued)

OTHER PUBLICATIONS

Tetsuji et al., Refrigeration Cycle, Jul. 2, 1999, (JPH11173698A), Whole Document.*

*Primary Examiner* — M. Alexandra Elve
*Assistant Examiner* — Larry Furdge
(74) *Attorney, Agent, or Firm* — Dentons US LLP

(57) ABSTRACT

An air conditioner and a method for controlling the same include a compressor, a condenser, an evaporator, a receiver for storing at least one portion of a refrigerant passing through the condenser and a gas/liquid separator for filtering a liquid refrigerant of the refrigerant introduced from the receiver to supply a gaseous refrigerant into the compressor includes a first flow rate regulator for controlling the amount of refrigerant supplied into the receiver, a second flow rate regulator for controlling the amount of refrigerant introduced from the receiver into the gas/liquid separator, a first detection unit for detecting the amount of refrigerant stored in the receiver, and a control unit for controlling an opening degree of the first or second flow rate regulator, based on information of at least one of the amount of refrigerant detected by the first detection unit and the amount of refrigerant circulating in the air conditioner.

13 Claims, 5 Drawing Sheets

(56) References Cited

FOREIGN PATENT DOCUMENTS

| | | | | |
|---|---|---|---|---|
| JP | H11173698 | A | * | 7/1999 |
| JP | 2007093141 | A | | 4/2007 |
| JP | 2010127531 | A | | 6/2010 |
| KR | 10-2009-0020305 | | | 2/2009 |
| KR | 10-2009-0082582 | | | 7/2009 |

* cited by examiner

AIR CONDITIONER AND METHOD FOR CONTROLLING THE SAME

CROSS-REFERENCE TO RELATED APPLICATIONS

The present application claims priority under 35 U.S.C. 119 and 35 U.S.C. 365 to Korean Patent Application No. 10-2011-0092061 (filed on Sep. 9, 2011), which is hereby incorporated by reference in its entirety.

BACKGROUND

The present disclosure relates to an air conditioner and a method for controlling the same.

Generally, a multi-type air conditioner is an apparatus in which a plurality of indoor units are connected to one outdoor unit, and also a plurality of pipes are connected to the outdoor unit to supply a refrigerant into each of the indoor units, thereby air-conditioning an indoor space. The multi-type air conditioner has an advantage in which an area of the outdoor unit can be reduced when compared to that of the prior air conditioner.

FIG. 1 is a schematic view of a multi-type air conditioner according to a related art. Referring to FIG. 1, a multi-type air conditioner 100 according to a related art includes a plurality of indoor units 110, an outdoor heat exchanger 120, an overcooling heat exchanger 130, a compressor 140, a gas/liquid separator 150.

In the multi-type air conditioner 100 according to the related art, when the air conditioner 100 is operated in a cooling mode, a refrigerant discharged from the compressor 140 passes through a 4-way valve and is condensed in the outdoor heat exchanger 120 (e.g., a condenser). Then, the refrigerant is discharged from the outdoor heat exchanger 120 in a high-temperature high-pressure liquid state.

Thereafter, the refrigerant is decreased in temperature while passing through the overcooling heat exchanger 130 and flows into each of the indoor units 110. Then, the refrigerant is phase-changed into a two-phase refrigerant while passing through an electric expansion valve (EEV) of each of the indoor units 110. Also, the refrigerant is heated by heat-exchanging with indoor air while passing through the indoor units 110 (e.g., evaporator), and then flows into the outdoor heat exchanger 120. Thereafter, the refrigerant flows into the compressor 140 via the 4-way valve and the gas/liquid separator 150.

On the other hand, when the air conditioner is operated in a heating mode, the indoor units 110 serve as condensers and the outdoor heat exchanger 120 serves as an evaporator. Thus, the refrigerant may flow in a direction opposite to the flow direction in case where the air conditioner is operated in the cooling mode.

However, in the multi-type air conditioner according to the related art, when the air conditioner is partially operated in the cooling mode, a portion of the indoor units 110 is stopped. Also, a refrigerant having a low pressure gaseous state may exist in the stopped indoor unit 110. Here, when the refrigerant is sealed in consideration of the number of operational indoor units 110, the refrigerant within nonoperational indoor units 110 is moved into the outdoor heat exchanger 120. Thus, the amount of refrigerant within a system may be varied. As a result, a distribution of the refrigerant amount may not be optimum, and thus operation efficiency may be deteriorated.

Also, in case of the heating operation, the functions of the condenser and the evaporator may be exchanged with each other. Thus, since a volume ratio for heat-exchanging between the indoor units and the outdoor unit may be changed according to the number of operational indoor units 110, the refrigerant may lean to one side.

SUMMARY

Embodiments provide an air conditioner in which a receiver and a gas/liquid separator are integrated with each other to reduce manufacturing costs and a refrigerant is temporarily stored in the receiver to effectively adjust the amount of refrigerant circulating in a system and a method for controlling the same.

In one embodiment, an air conditioner including a compressor, a condenser, an evaporator, a receiver for storing at least one portion of a refrigerant passing through the condenser and a gas/liquid separator for filtering a liquid refrigerant of the refrigerant introduced from the receiver to supply a gaseous refrigerant into the compressor includes: a first flow rate regulator for controlling the amount of refrigerant supplied into the receiver; a second flow rate regulator for controlling the amount of refrigerant introduced from the receiver into the gas/liquid separator; a first detection unit for detecting the amount of refrigerant stored in the receiver; and a control unit for controlling an opening degree of the first or second flow rate regulator, based on information of at least one of the amount of refrigerant detected by the first detection unit and the amount of refrigerant circulating in the air conditioner.

In another embodiment, a method for controlling an air conditioner including a condenser, an evaporator, a receiver for storing at least one portion of a refrigerant passing through the condenser, and a gas/liquid separator for filtering a liquid refrigerant from a refrigerant to be introduced into a compressor includes: storing at least one portion of the refrigerant into the receiver according to the amount of refrigerant circulating in the air conditioner; detecting the amount of refrigerant stored in the receiver; and selectively introducing the refrigerant stored in the receiver into the gas/liquid separator, based on information of at least one of the amount of refrigerant stored in the receiver and the amount of refrigerant circulating in the air conditioner.

The details of one or more embodiments are set forth in the accompanying drawings and the description below. Other features will be apparent from the description and drawings, and from the claims.

DETAILED DESCRIPTION OF THE EMBODIMENTS

Hereinafter, an air conditioner and a method for controlling the same according to an embodiment will be described in detail with reference to accompanying drawings.

Figure 1:
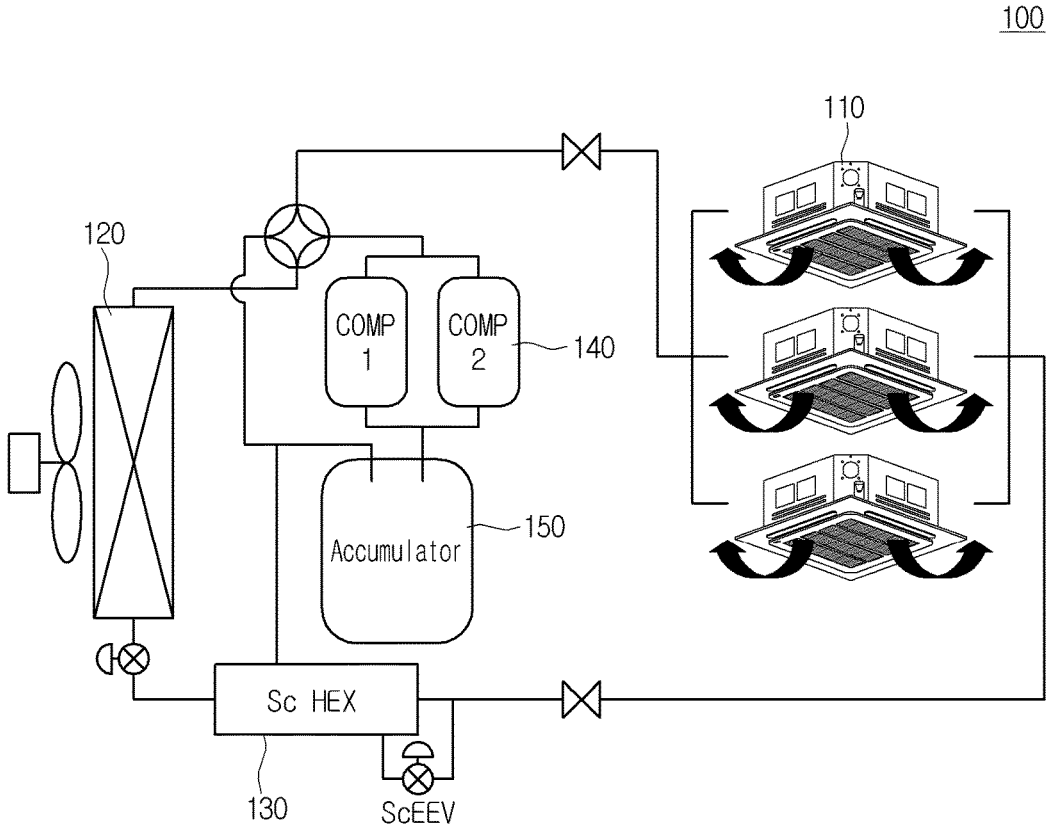
FIG. 1 is a schematic view of a multi-type air conditioner according to a related art.
Figure 2:
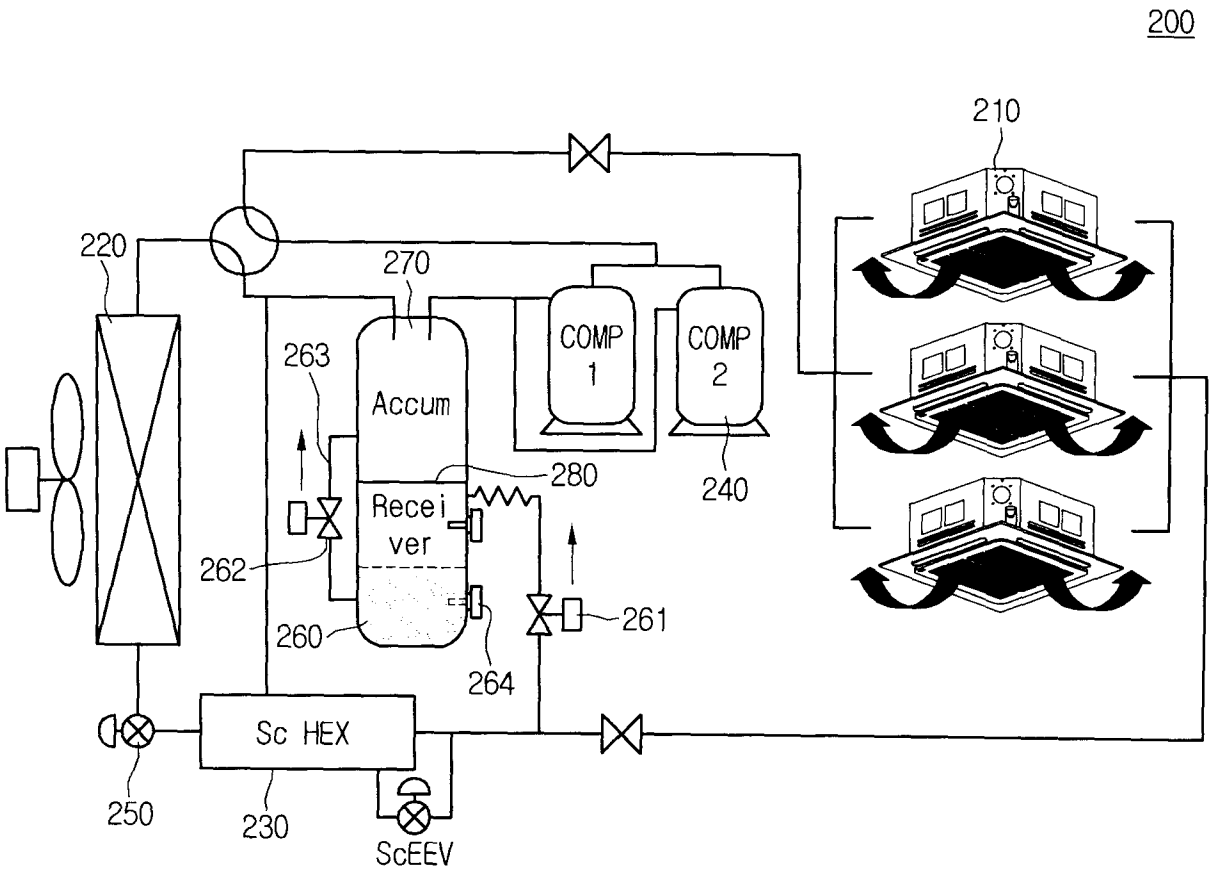
FIG. 2 is a schematic view of an air conditioner according to an embodiment.
Figure 3:
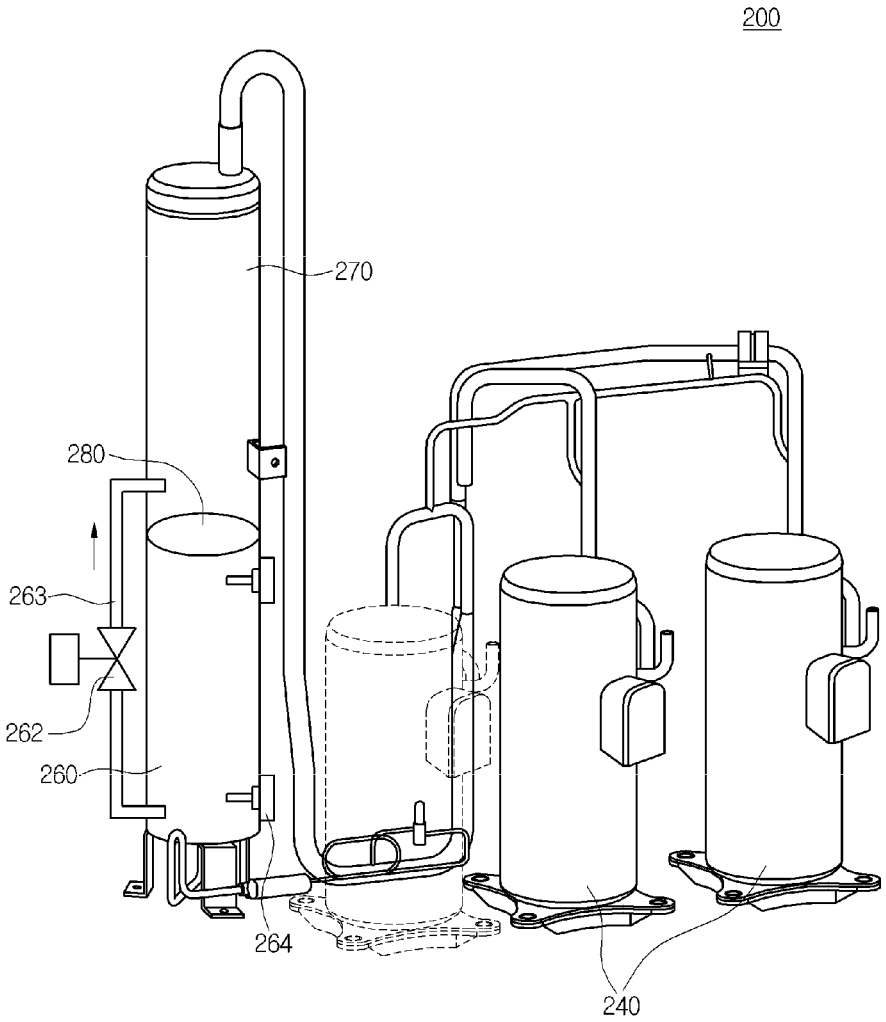
FIG. 3 is a perspective view of an air conditioner according to an embodiment.
Figure 4:
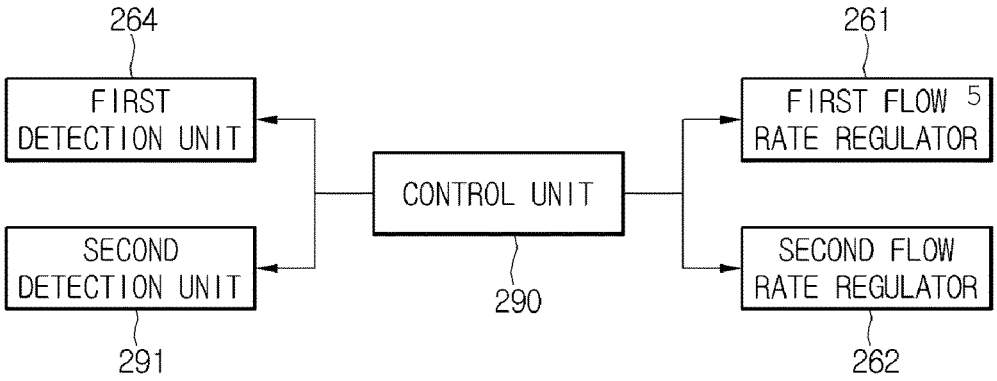
FIG. 4 is a block diagram of an air conditioner according to an embodiment.

FIG. 2 is a schematic view of an air conditioner according to an embodiment. FIG. 3 is a perspective view of an air conditioner according to an embodiment. FIG. 4 is a block diagram of an air conditioner according to an embodiment.

Referring to FIG. 2, an air conditioner 200 according to an embodiment includes an indoor unit 210, an outdoor heat exchanger 220, an overcooling heat exchanger 230, a compressor 240, and an expansion unit 250. In addition, the air conditioner 200 further includes a receiver 260, a gas/liquid separator 270, a first flow rate regulator 261, a second flow rate regulator 262, a bypass line 263, a first detection unit 264, and a control unit 290.

The indoor unit 210 serves as an evaporator for evaporating a refrigerant having a low-temperature low-pressure liquid state to change into a refrigerant having a gaseous state when the air conditioner 200 is operated in a cooling mode. Also, the indoor unit 210 serves as a condenser for condensing a refrigerant having a high-temperature high-pressure liquid state to change into a refrigerant having a room-temperature high-pressure liquid state when the air conditioner 200 is operated in a heating mode. A plurality of indoor units 210 may correspond to one outdoor heat exchanger 220. Here, the present disclosure is not limited to a shape of the indoor unit 210.

The outdoor heat exchanger 220 serves as a condenser for condensing a refrigerant having a high-temperature high-pressure liquid state to change into a refrigerant having a room-temperature high-pressure liquid state when the air conditioner 200 is the cooling mode. Also, the outdoor heat exchanger 220 serves as an evaporator for evaporating a refrigerant having a low-temperature low-pressure liquid state to change into a refrigerant having a gaseous state when the air conditioner 200 is operated in the heating mode. The outdoor heat exchanger 220 may be operated on the opposite principle of the indoor unit 210 according to the circulation of the refrigerant. Thus, the air conditioner 200 may be alternatively operated according to the user's needs.

The overcooling heat exchanger 230 overcools a refrigerant to supply the overcooled refrigerant into the evaporator. The overcooling heat exchanger 230 may overcool a high-pressure liquid refrigerant flowing into the evaporator to improve cooling performance.

The compressor 240 compresses the low-temperature low-pressure refrigerant to change into a high-temperature high-pressure refrigerant, thereby supplying the high-temperature high-pressure refrigerant into the evaporator. The compressor 240 may be provided in plurality. Also, the compressor 240 may be connected to the gas/liquid separator 270 to receive the gaseous refrigerant from the gas/liquid separator 270, thereby compressing the gaseous refrigerant to change into a high-temperature high-pressure refrigerant. The compressor 240 may be an inverter compressor in which an operating frequency is variable or a regular velocity compressor which uses a fixed operating frequency.

The expansion unit 250 expands the room-temperature high-pressure liquid refrigerant passing through the condenser to change into a low-temperature low-pressure refrigerant, thereby supplying the low-temperature low-pressure refrigerant into the evaporator. The expansion unit 250 may be an electric expansion valve. Also, the expansion unit 250 may be built in an outdoor unit (not shown) together with the outdoor heat exchanger 220.

The receiver 260 stores at least one portion of the refrigerant passing through the condenser. The receiver 260 may temporarily store a refrigerant to be introduced into the gas/liquid separator 270 and selectively introduce the refrigerant into the gas/liquid separator 270 to effectively control the amount of refrigerant circulating in the air conditioner 200. A specific process for controlling the amount of refrigerant will be described in detail together with descriptions of the control unit 290.

The gas/liquid separator 270 filters a liquid refrigerant of the refrigerant introduced from the receiver 260 to supply a gaseous refrigerant into the compressor 240. Since compression efficiency may be deteriorated in case where the liquid refrigerant flows into the compressor 240, the gas/liquid separator 270 may filter the liquid refrigerant to introduce only the gaseous refrigerant into the compressor 240.

Here, the gas/liquid separator 270 may be integrated with the receiver 260. In the current embodiment, the receiver 260 and the gas/liquid separator 270 may be integrally manufactured to save an installation space and reduce manufacturing costs. The integrated structure of the receiver 260 and the gas/liquid separator 270 will be described in detail with reference to FIG. 3.

Referring to FIGS. 3 and 4, in the air conditioner 200 according to an embodiment, the integrated structure of the receiver 260 and the gas/liquid separator 270 may be called a refrigerant storage unit. The refrigerant storage unit includes a refrigerant storage part defining the receiver 260, a refrigerant separation part defining the gas/liquid separator 270, and a partition part 280 for partitioning the refrigerant storage part and the refrigerant separation part.

That is, the receiver 260 and the gas/liquid separator 270 may be bisected by the partition part 280. Specifically, the receiver 260 and the gas/liquid separator 270 may have a cylindrical shape and bisected by the partition part 280 having a horizontal wall shape.

Here, a portion at which the receiver 260 and the gas/liquid separator 270 contact each other may have a section width relatively less than a height of the receiver 260 or the gas/liquid separator 270. This is done for a reason in which the installation space is saved and the contact area between the receiver 260 and the gas/liquid separator 270 is minimized to prevent its structure from being damaged by a difference between internal pressures of the receiver 260 and the gas/liquid separator 270.

The first flow rate regulator 261 controls the amount of refrigerant supplied into the receiver 260. When the plurality of indoor units 210 correspond to the one outdoor heat exchanger 220, if only a portion of the indoor units 210 is operated during the cooling operation, the amount of refrigerant within the outdoor heat exchanger 220 serving as the condenser may be excessive. In this case, a high-pressure operation may occur to reduce the efficiency. Thus, in the current embodiment, the first flow rate regulator 261 may be opened to store a portion of the refrigerant in the receiver 260 to effectively control the amount of refrigerant circulating in the entire air conditioner 200. Here, the first flow rate regulator 261 may be a valve.

The second flow rate regulator 262 controls the amount of refrigerant introduced from the receiver 260 into the gas/liquid separator 270. When it is determined that the amount of refrigerant circulating in the air conditioner 200 is insufficient, it may be necessary to utilize the refrigerant stored in the receiver 260. Here, in the current embodiment, the second flow rate regulator 262 may be opened to supply the refrigerant stored in the receiver 260 into the gas/liquid separator 270 to smoothly realize the cooling or heating operations. The second flow rate regulator 262 may be a valve. Also, the second flow rate regulator 262 may be disposed in the bypass line 263 that will be described below in detail.

The bypass line 263 allows the receiver 260 and the gas/liquid separator 270 to communicate with each other. Since the refrigerant stored in the receiver 260 should be transferred into the compressor 240 via the gas/liquid separator 270 as necessary, the bypass line 263 may be provided to connect the receiver 260 and the gas/liquid separator 270 in the current embodiment. Here, since the receiver 260 and the gas/liquid separator 270 are integrally manufactured, the bypass line may be minimized in length.

The first detection unit 264 detects the amount of refrigerant stored in the receiver 260. When the first flow rate regulator 261 is opened to store the refrigerant in the receiver 260 because the amount of refrigerant within the condenser is excessive, the amount of stored refrigerant may be frequently detected to prevent a refrigerant from being excessively injected into the receiver 260. Thus, in the current embodiment, the first detection unit 264 may be attached to a side surface of the receiver 260 to detect the amount of refrigerant stored in the receiver 260 and restrict the inflow of the refrigerant as necessary. Here, since the refrigerant stored in the receiver 260 is a liquid refrigerant, the first detection unit 264 may be an oil level sensor for measuring an oil level of the refrigerant. Also, the first detection unit 264 may measure the amount of refrigerant in real time or with a certain time interval.

The control unit 290 controls an opening degree of the first flow rate regulator 261 or the second flow rate regulator 262, based on information of at least one of the amount of refrigerant detected by the first detection unit 264 or the amount of refrigerant circulating in the air conditioner 200. In more detail, the control unit 290 controls an opening degree of the first flow rate regulator 261 according to the amount of refrigerant contained in the condenser and an opening degree of the second flow rate regulator 262 according to the amount of refrigerant contained in the evaporator.

Here, the control unit 290 may check the amount of refrigerant circulating in the air conditioner 200, the amount of refrigerant contained in the condenser, or the amount of refrigerant contained in the evaporator using the second detection unit 291 for detecting the amount of refrigerant. For this, the second detection unit 291 may be provided in the condenser or the evaporator.

Also, the control unit 290 may control an opening degree of the first flow rate regulator 261 or the second flow rate regulator 262 by comparing the amount of refrigerant contained in the condenser with the amount of refrigerant contained in the evaporator. Also, the control unit 290 may control an opening degree of the first flow rate regulator 261 or the second flow rate regulator 262 according to variations of refrigerant volumes of the condenser and the evaporator when the cooling and heating modes are switched.

When the one outdoor heat exchanger 220 is connected to the plurality of indoor units 210 to perform the cooling mode, if only a portion of the plurality of the indoor units 210 is operated, the refrigerant may be accumulated into the outdoor heat exchanger 220 having a relatively large refrigerant volume. Thus, the system efficiency may be significantly reduced. Thus, the control unit 290 may open the first flow rate regulator 261 to introduce the refrigerant into the receiver 260. As a result, an adequate amount of refrigerant may remain in the outdoor heat exchanger 220 to improve the efficiency of the air conditioner 200.

On the other hand, when the refrigerant is sufficiently accumulated in the receiver 260, the first flow rate regulator 261 may be closed to prevent the refrigerant from further flowing into the receiver, thereby realizing the safety of the receiver 260. Here, the control unit 290 may control the opening degree of the first or second flow rate regulator 261 or 262 according to the amount of refrigerant detected by the first detection unit 264.

In more detail, the control unit 290 may selectively close the first flow rate regulator 261 or selectively open the second flow rate regulator 262 when the amount of refrigerant detected by the first detection unit 264 is over a preset value. Alternatively, the control unit 290 may control the opening degree of the first or second flow rate regulator 261 or 262 according to a difference between the amount of refrigerant detected by the first detection unit 264 and the preset value. Thus, an adequate amount of refrigerant may be stored in the receiver 260 at all times.

Also, the control unit 290 may open the second flow rate regulator 262 when the supply of the refrigerant into the evaporator is required. Thus, the refrigerant may be introduced from the receiver 260 into the gas/liquid separator 270 and then transferred into the evaporator through the compressor 240. The supply of the refrigerant into the evaporator may denote that the amount of refrigerant contained in the evaporator is significantly insufficient when compared to that of refrigerant contained in the condenser or that the amount of refrigerant within the evaporator is relatively insufficient because a volume of the refrigerant within the evaporator is significantly increased when compared to that of the refrigerant within the condenser.

That is, when the refrigerant volumes of the condenser and the evaporator are varied due to the switching of the cooling and heating modes or utilizing only a portion of the plurality of indoor units 210 in the cooling mode, the control unit 290 may control the receiver 260 to temporarily store the refrigerant in the receiver 260. In addition, as necessary, the control unit 290 may discharge the refrigerant from the gas/liquid separator 270. Thus, in the current embodiment, the amount of refrigerant circulating in the air conditioner 200 may be adequately maintained at a certain level to improve the cooling and heating efficiency of the system.

Figure 5:
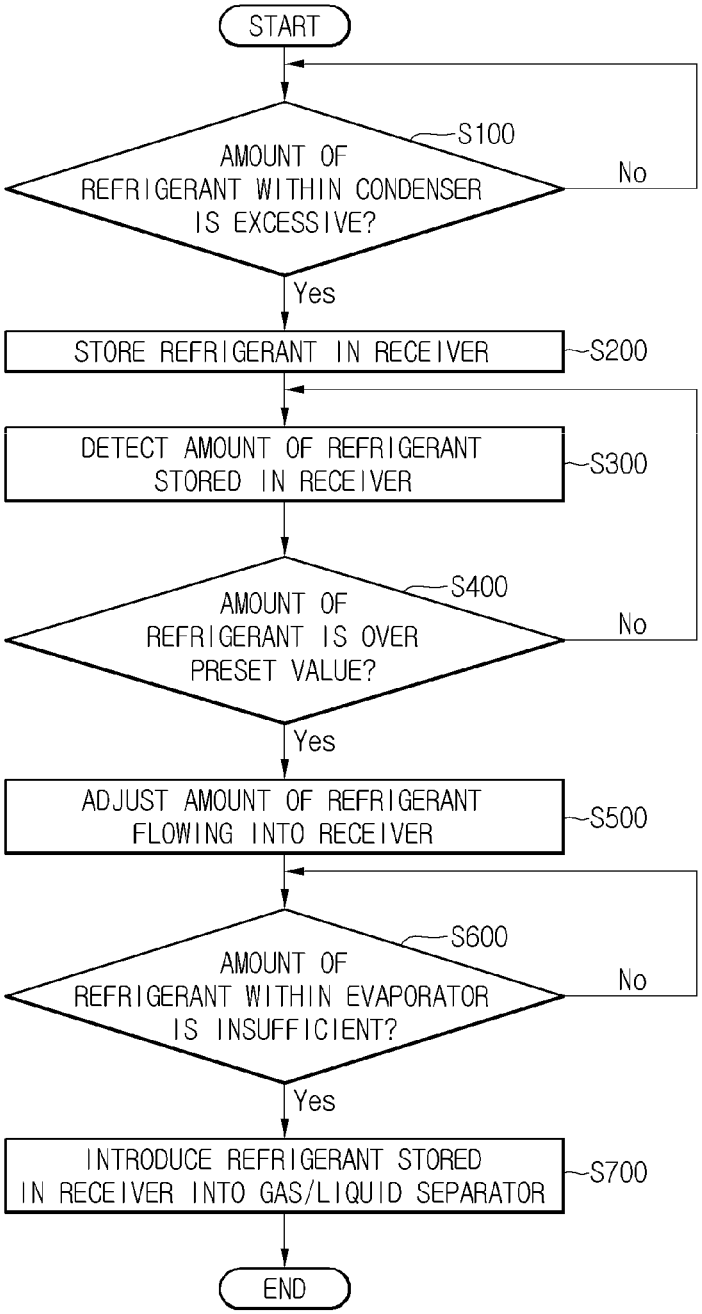
FIG. 5 is a flowchart illustrating a process for controlling an air conditioner according to an embodiment.

FIG. 5 is a flowchart illustrating a process for controlling an air conditioner according to an embodiment.

Referring to FIG. 5, in a method for controlling an air conditioner according to an embodiment, at least one portion of a refrigerant is stored in a receiver 260 (S200) according to the amount of refrigerant circulating the air conditioner 200 (S100). Here, the amount of refrigerant circulating in the air conditioner 200 may denote the amount of refrigerant contained in a condenser.

This is done for a reason in which it prevents a refrigerant from being excessively accumulated into an outdoor heat exchanger 220 that is a condenser to reduce system efficiency when only a portion of indoor units 210 is operated during the cooling mode in the multi-type air conditioner 200 including the plurality of indoor units 210. That is, when the refrigerant is excessively accumulated in the condenser, the refrigerant may flow into the receiver 260 according to the amount of refrigerant contained in the condenser to prevent efficiency of the condenser from being deteriorated.

Here, the amount of refrigerant stored in the receiver 260 is detected by a first detection unit 264 in real time or with a certain time interval (S300). When the refrigerant is excessively stored in the receiver 260, the receiver 260 may have a loss of safety itself and be damaged in structure. Thus, in the current embodiment, the amount of refrigerant stored in the receiver 260 may be detected using the first detection unit 264. Also, the amount of refrigerant flowing into the receiver 260 may be controlled (S500), based on whether the detected amount of refrigerant is over a preset value (S400).

In the current embodiment, when the amount of refrigerant detected by the first detection unit 264 is over the preset value, a control unit 290 may prevent the refrigerant from flowing into the receiver 260. Alternatively, the control unit 290 may control the amount of refrigerant flowing into the receiver 260 according to a difference between the detected amount of refrigerant and the preset value.

Thereafter, the refrigerant stored in the receiver 260 may selectively flow into a gas/liquid separator 270 (S700) according to the amount of refrigerant circulating in the air conditioner 200 (S600). This is done for a reason in which it prevents the amount of refrigerant circulating in the air conditioner 200 from being lacked because the refrigerant passing through the condenser is stored in the receiver 260. Specifically, the amount of refrigerant introduced from the receiver 260 into the gas/liquid separator 270 may be controlled by the control unit 290 according to the amount of refrigerant contained in the evaporator.

Alternatively, when it is determined that the amount of refrigerant detected by the first detection unit 264 is excessive, the refrigerant may be introduced from the receiver 260 into the gas/liquid separator 270. Thus, the adequate amount of refrigerant may be stored in the receiver 260.

In the current embodiment, the receiver 260 and the gas/liquid separator 270 may be integrally formed. Here, the receiver 260 and the gas/liquid separator 270 may have a cylindrical shape and be bisected by a vertical wall or a horizontal wall. A portion at which the receiver 260 and the gas/liquid separator 270 contact each other may have a section width relatively less than a height of the receiver 260 or the gas/liquid separator 270.

As described above, when only a portion of the plurality of evaporators is utilized during the cooling mode, a portion of the refrigerant may be stored in the receiver 260 to improve the system efficiency. Also, in the current embodiment, the amount of refrigerant stored in the receiver 260 may be frequently detected and also the refrigerant inflow into the receiver 260 may be blocked as necessary so that the adequate amount of refrigerant is stored in the receiver 260.

On the other hand, when the cooling and heating modes are switched to more expand the refrigerant volume of the evaporator than that of the condenser, the amount of refrigerant circulating in the air conditioner 200 may lacked. Here, in the current embodiment, the refrigerant stored in the receiver 260 may flow into the gas/liquid separator 270 to supply the refrigerant into the compressor 240, thereby maintaining the system efficiency in the optimum state.

According to the embodiment, the receiver and the gas/liquid separator may be integrally manufactured to reduce the manufacturing costs. Also, the refrigerant may be temporarily stored in the receiver to effectively control the amount of refrigerant circulating in a system.

Also, according to the embodiment, the first detection unit may be attached to the receiver and the receiver and the gas/liquid separator may communicate with each other through the bypass line to control the amount of refrigerant within the air conditioner. Thus, the air conditioning performance may be improved.

Also, according to the embodiments, the circulating amount of refrigerant may be optimized to operate the system in a state where the system efficiency is optimum even though the cooling and heating modes are switched, the number of nonoperational indoor units is changed, or the operation conditions such as a change of the indoor temperature are changed.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

What is claimed is:

1. An air conditioner comprising a compressor, a condenser, an evaporator, a receiver for storing at least one portion of a refrigerant passing through the condenser and a gas/liquid separator for filtering a liquid refrigerant of the refrigerant introduced from the receiver to supply a gaseous refrigerant into the compressor, the air conditioner comprising:

a first flow rate regulator for controlling the amount of refrigerant supplied into the receiver;

a second flow rate regulator for controlling the amount of refrigerant introduced from the receiver into the gas/liquid separator;

a first sensor to detect a level of refrigerant stored in the receiver;

a second sensor to detect a level of refrigerant contained in the condenser or evaporator, the second sensor being disposed inside the condenser or the evaporator;

a bypass line allowed the receiver and the gas/liquid separator for guiding the refrigerant of the receiver to the gas/liquid separator; and a control unit for controlling an opening degree of the first or second flow rate regulator, based on information of at least one of the level of refrigerant detected by the first sensor or the level of refrigerant detected by the second sensor, wherein the gas/liquid separator is integrated with the receiver and has storage part partitioned a storage part of the receiver, and wherein the control unit selectively closes the first flow rate regulator or selectively opens the second flow rate regulator when the level of refrigerant detected by the first sensor is over a preset value, and wherein the control unit open the second flow rate regulator when the supply of the refrigerant into the evaporator is required, and wherein the control unit controls the opening degree of the first or second flow rate regulator according to variations of refrigerant volumes of the condenser and the evaporator when cooling and heating modes are switched.

2. The air conditioner according to claim 1, wherein the control unit controls the opening degree of the first flow rate regulator according to the level of refrigerant contained in the condenser and the opening degree of the second flow rate regulator according to the level of refrigerant contained in the evaporator.

3. The air conditioner according to claim 1, wherein the control unit controls the opening degree of the first or second flow rate regulator by comparing the level of refrigerant contained in the condenser with the level of refrigerant contained in the evaporator.

4. The air conditioner according to claim 1, wherein the control unit controls the opening degree of the first or second flow rate regulator according to a difference between the level of refrigerant detected by the first sensor and a preset value.

5. The air conditioner according to claim 1, further comprising a bypass line allowing the receiver and the gas/liquid separator to communicate with each other, wherein the second flow rate regulator is disposed in the bypass line.

6. The air conditioner according to claim 1, further comprising:

a refrigerant storage part defining the receiver;

a refrigerant separation part defining the gas/liquid separator; and at least one wall arranged between the refrigerant storage part and the refrigerant separation part.

7. The air conditioner according to claim 6, wherein the refrigerant storage part and the refrigerant separation part are integrally manufactured in a refrigerant storage unit for storing the refrigerant circulating in the air conditioner, wherein the refrigerant storage unit comprises:

a partition part for partitioning the refrigerant storage part from the refrigerant separation part, the partition part comprising the at least one wall.

8. The air conditioner according to claim 6, wherein a portion at which the refrigerant storage part and the refrigerant separation part contact each other has a section width relatively less than a height of the refrigerant storage part or a height of the refrigerant separation part.

9. A method for controlling an air conditioner comprising a condenser, an evaporator, a receiver for storing at least one portion of a refrigerant passing through the condenser, and a gas/liquid separator for filtering a liquid refrigerant from a refrigerant to be introduced into a compressor, a first sensor for detecting the level of refrigerant stored in the receiver, a second sensor disposed inside the condenser or the evaporator for detecting the level of refrigerant contained in the condenser or evaporator, the method comprising:

storing at least one portion of the refrigerant into the receiver according to the level of refrigerant circulating in the air conditioner;

detecting the level of refrigerant stored in the receiver; and selectively introducing the refrigerant stored in the receiver into the gas/liquid separator, based on information of at least one of the level of refrigerant stored in the receiver and the level of refrigerant circulating in the air conditioner, selectively closing a first flow rate regulator or selectively opening a second flow rate regulator when the level of refrigerant detected by the first sensor or the second sensor, opening the second flow rate regulator when a supply of the refrigerant into the evaporator is required, and controlling an opening degree of the first or second flow rate regulator according to variations of refrigerant volumes of the condenser and the evaporator when a cooling mode or a heating mode is switched, wherein the gas/liquid separator is integrated with the receiver, and wherein the refrigerant of the receiver is introduced into the gas/liquid separator through a bypass line.

10. The method according to claim 9, further comprising controlling the level of refrigerant flowing into the receiver, based on whether the level of refrigerant stored in the receiver is over a preset value.

11. The method according to claim 9, wherein, in the storing of the refrigerant into the receiver, the level of refrigerant flowing into the receiver is controlled according to the level of refrigerant contained in the condenser, and in the introducing of the refrigerant into the gas/liquid separator, the level of refrigerant flowing into the gas/liquid separator is controlled according to the level of refrigerant contained in the evaporator.

12. The method according to claim 9, wherein, in the introducing of the refrigerant into the gas/liquid separator, the level of refrigerant flowing into the gas/liquid separator is controlled by comparing the level of refrigerant contained in the condenser with the level of refrigerant contained in the evaporator.

13. The method according to claim 9, wherein, in the introducing of the refrigerant into the gas/liquid separator, the level of refrigerant flowing into the gas/liquid separator is controlled according to variations of refrigerant volumes of the condenser and the evaporator when cooling and heating modes are switched.

* * * * *